United States Patent [19]

Henricksen

[11] 4,050,541

[45] Sept. 27, 1977

[54] ACOUSTICAL TRANSFORMER FOR HORN-TYPE LOUDSPEAKER

[75] Inventor: Clifford A. Henricksen, Yorba Linda, Calif.

[73] Assignee: Altec Corporation, Anaheim, Calif.

[21] Appl. No.: 678,873

[22] Filed: Apr. 21, 1976

[51] Int. Cl.[2] ..... G10K 11/06

[52] U.S. Cl. ..... 181/159; 181/185; 179/115.5 H

[58] Field of Search ..... 181/159, 177, 184–188; 179/115.5 H

[56] References Cited

U.S. PATENT DOCUMENTS

| | | | |
|---|---|---|---|
| 2,037,187 | 4/1936 | Wente | 181/159 X |
| 2,183,528 | 12/1939 | Blackburn | 181/159 |
| 2,858,377 | 10/1958 | Levy | 181/159 X |
| 2,942,071 | 6/1960 | Witchey | 181/159 X |
| 3,852,529 | 12/1974 | Schafft | 179/1 MG |

*Primary Examiner*—Lawrence R. Franklin

*Attorney, Agent, or Firm*—Edward A. Sokolski

[57] ABSTRACT

An acoustical transformer or "phasing plug" for coupling sound from a speaker diaphragm to the throat of a horn. The phasing plug of the invention is in the general shape of a dome on one side and a truncated cone on the other, and has evenly spaced radial slots or channels formed therein, these slots forming air passageways for propagation of the soundwaves. The walls of the slots are tapered exponentially from their inlet ends at the speaker diaphragm towards a flat plane outlet at the throat of the horn, to provide an optimum impedance match between the output of the diaphragm and the input of the horn; the sound channels formed by the slots exponentially increasing in area between their inlets and outlets. Transformation from a spherical wave front at the input to a plane wave front at the outlet is assured by the shaping of the channels to make the distances between corresponding points at the channel inlets and outlets equal to each other.

12 Claims, 9 Drawing Figures

ACOUSTICAL TRANSFORMER FOR HORN-TYPE LOUDSPEAKER

This invention relates to horn-type loudspeakers, and more particularly to an improved acoustical transformer or phasing plug for use in such loudspeakers.

In horn type loudspeakers, an acoustical transformer, commonly known as a "phasing plug", is used to impedance match the output of the speaker diaphragm to the throat of the horn. The design of this transformer is particularly important to assure good frequency response in the high frequency range (above 7 kHz). Generally a throat diameter which is small compared with that of the diaphragm is utilized.

In the prior art, acoustical transformers have generally taken the form of a plurality of annular concentric channels tapered outwardly from their inlets to their outlets. This type of transformer or phasing plug operates quite efficiently. However, it is somewhat difficult and expensive to construct in that it cannot be molded in one piece due to difficulties in removing this type of structure from a mold. to obviate this shortcoming, various attempts have been made to design speaker plugs utilizing radial slots or channels. Such prior art devices are described in U.S. Pat. No. 2,832,844 to Matsuoka, and U.S. Pat. No. 2,183,528 to Blackburn. In U.S. Pat. No. 2,832,844, the acoustic transformer has radial slots which are rectangular in cross-section. There is no coupling transition provided between the diaphragm output and the throat of the horn, as in the present invention. In U.S. Pat. No. 2,183,528, an attempt is made to impedance match the output of the diaphrgm to the horn throat by flaring the channels. In the device of U.S. Pat. No. 2,183,528, however, there is no exponential expansion of the channels to provide a smooth transition in coupling the sound between the diaphragm and the throat of the horn and for converting the spherical wave front of the sound waves radiated by the diaphragm to a planar wave front for coupling to the throat, as in the present invention. Further, in the device of this patent, an air space is left between the phasing plug and the sides of the pole piece at the output end of the plug, which is likely to produce distortion. In the device of the present invention, no such air space is allowed, i.e., the phasing plug matingly abuts against the pole piece thereby permitting full control of the airflow in each of the similar exponential channels, and avoiding the development of distortion compnents. To avoid loss of frequency response at higher frequencies of interest the spacing between adjacent channels is minimized. Further, in a preferred embodiment of the present invention, a prime number of channels is used which minimizes the generation of harmonic components in the diaphragm, this design parameter not being taught or suggested in either of these prior art patents.

It is therefore an object of this invention to provide a phasing plug which is easier and more economical to fabricate.

It is another object of this invention to provide a phasing plug utilizing radial sound channels having improved efficiency and lower distortion than prior art plugs utilizing radial channels.

It is still a further object of this invention to provide a phasing plug for loudspeakers using radial sound coupling channels capable of transforming a spherical wavefront at its input to a plane wavefront at its output.

Other objects of this invention will become apparent as the description proceeds in connection with the accompanying drawings, of which:

Figure 6:
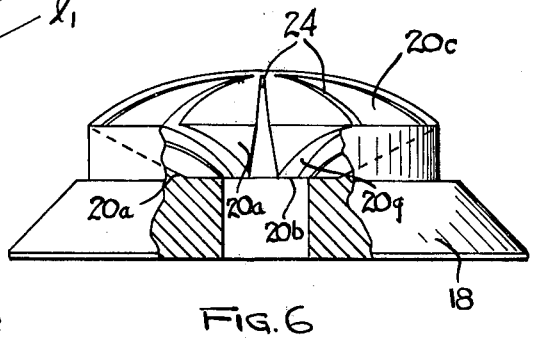
Figure 5:
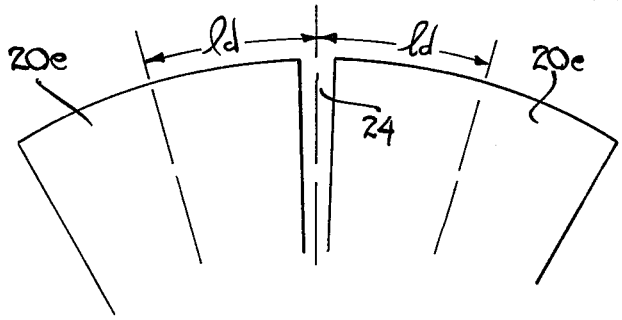
Figure 7A:
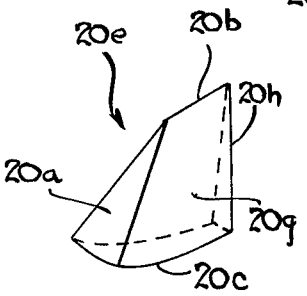
Figure 7B:
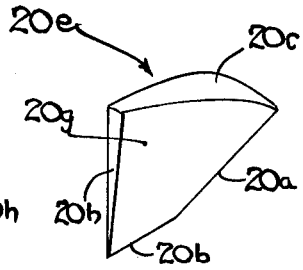
Figure 8:
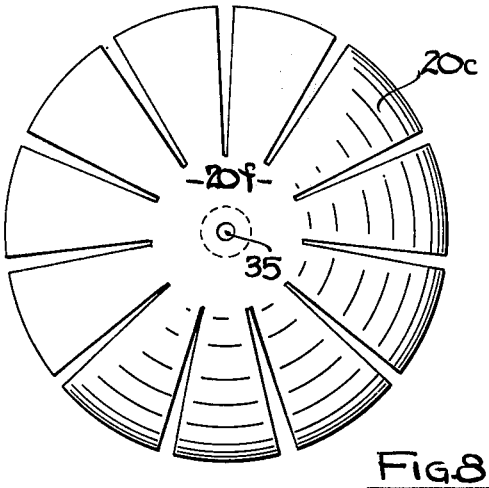

FIB. 4 is a diagrammatic view illustrating the walls of the channels of the preferred embodiment;

FIG. 5 is a diagrammatic view illustrating dimensional relationships of the channel separator "slices" of the preferred embodiment;

FIG. 6 is a side elevational view of the preferred embodiment installed in a pole piece unit;

FIGS. 7A and 7B are perspective views of the channel separator "slices" of the preferred embodiment; and FIG. 8 is a plan view of the sound input end of an alternative embodiment of the invention.

Briefly described, the device of the invention is as follows: The phasing plug has a dome shaped surface on its sound input side and a truncated cone shaped surface on the opposite side. A plurality of radial slots or channels are formed between the two surfaces, there preferably being a prime number of such channels. Each of the channels is used to impedance match the output of the speaker diaphragm to the input of the horn and expands exponentially from its inlet, which receives sound from the speaker diaphragm, to its outlet which is in the form of a plane and which feeds the sound to the throat of the horn. The distances between corresponding points along the arcuate inlet of each channel and the flat outlet thereof are all equal to each other, to make for optimum transformation of the sound waves from a spherical to a planar wavefront. Further, the separation between adjacent channels of the plug is made small enough so that a resonant stading wave will not appear within the frequency range of desired operation. In an alternative embodiment of the invention, an aperture is placed in the central ("core") portion of the phasing plug to further prevent such a resonant condition at any frequency of interest. In the preferred embodiment, a prime number of channels is used to minimize the generation of harmonic signals.

Figure 1:
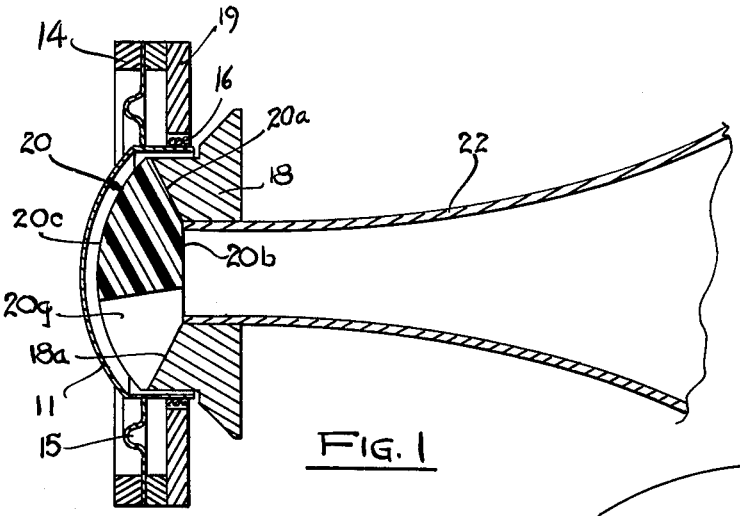
FIG. 1 is a cross-sectional view of a preferred embodiment of the invention as incorporated into a horn-type loudspeaker.

Referring now to FIG. 1, a preferred embodiment of the invention is shown as installed in a horn-type speaker. The speaker diaphragm 11 is resiliently supported on speaker frame 14 by means of spider 15. A voice coil 16 is wound on the coil form portion of the diaphragm structure and is located in the magnetic gap formed between pole piece elements 18 and 19. An acoustical transformer or phasing plug 20 is mounted with a portion of surface **20*a* thereof, which is shaped in the form of a truncated cone, in abutment against the mating surface 18*a* of pole piece 18. The central portion of the inner periphery of the phasing plug is formed by sharp straight line edges 20*b* and flat surfaced plug portion 20*f*. The outer surface 20*c* of the phasing plug is dome shaped and is positioned opposite diaphragm 11. The sphericity of surface 20*c* corresponds to that of the diaphragm. The straight line edges 20*b* are positioned opposite the throat of horn 22. Sound is coupled through the radial channels formed in phasing plug 20 from spherical diaphragm 11 which radiates sound having a spherical wave front, to the throat of horn 22,** the spherical wave front being transformed to a planar wave front by the phasing plug, as to be described further on in the specification.

Figure 2:
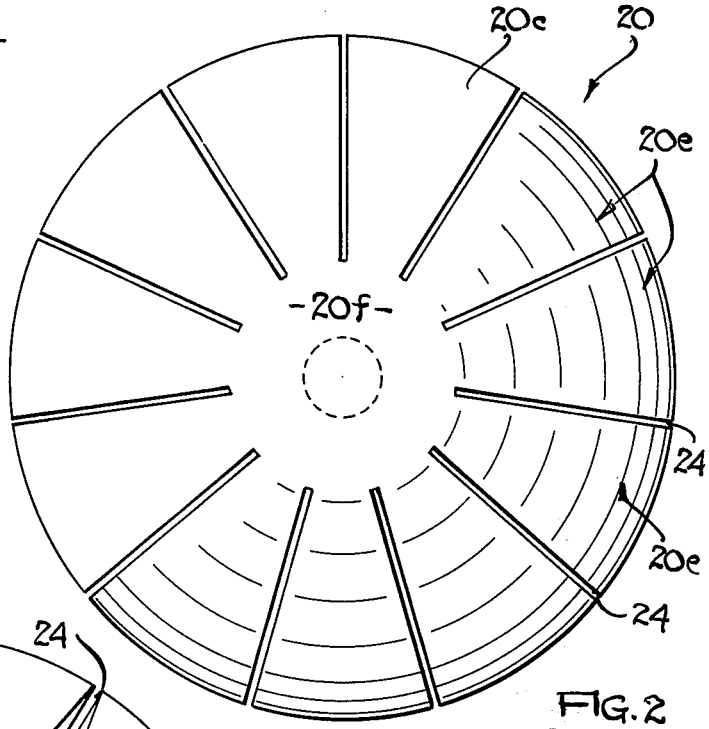
FIG. 2 is a plan view illustrating the input side of the preferred embodiment.
Figure 3:
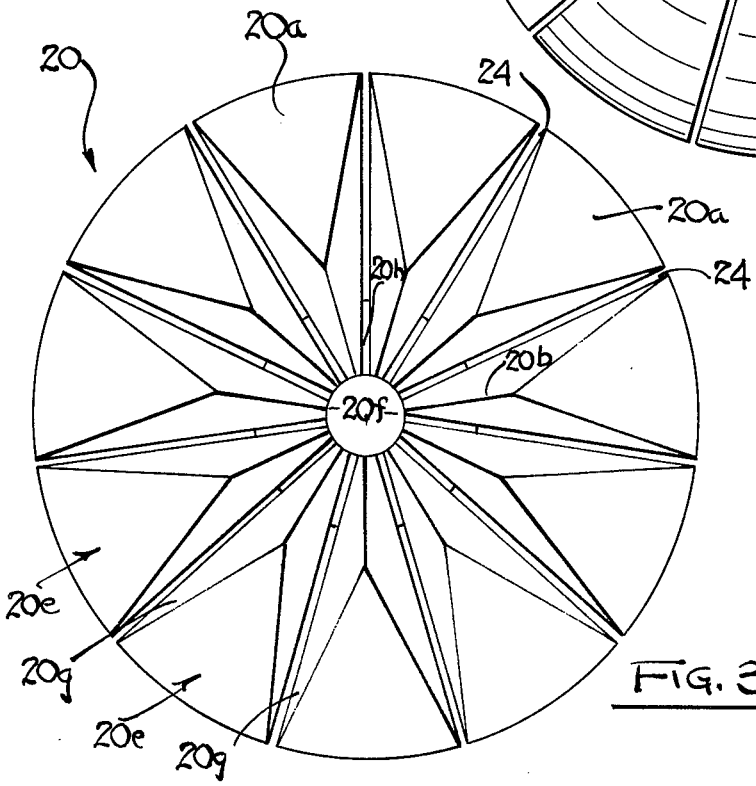
FIG. 3 is a plan view illustrating the output side of the preferred embodiment.

Referring now to FIGS. 2 and 3, a preferred embodiment of the phasing plug of the invention is illustrated. The input side of the plug, as illustrated in FIG. 2, has a dome shaped surface 20*c*, while the opposite formed by surfaces 20*a* along with central straight line edges 20*b* and central portion 20*f* is generally in the form of a truncated cone. A plurality of radial channels 24, which extend between surfaces 20*c* and 20*a*, are formed between plug sections or "slices" 20*e*, the side wall portions 20*g* of the sections having an exponential curvature. The central or "core" portion 20*f* of the plug is conically shaped, the central portions 20*h* (see FIG 7B) of the "slices" running along the sides of the cone.

For cnvenience of illustration, the plug sections or "slices" are shown in FIGS. 7A and 7B as separate elements. It is to be understood, however, that the plug is fabricated as an integral unit and there are no such separate pieces. Surface 20*g* is quadric, i.e., it has an exponential curvature. Surface 20*c* is spherical to match the sphericity of the speaker diaphragm. Surface 20*a* is conical to mate with the pole piece 18. Surface 20*h* is conical to mate with conical plug section 20*f*. Edge 20*b* runs in a straight line.

Referring now to FIG. 6, the preferred embodiment of the phasing plug as installed in pole piece 18 is illustrated. Surface portions 20*a* abut against the dished surface of the pole piece in mating relationship therewith, leaving no space therebetween, while the edge portions 20*b* are opposite the central apertured portion of pole piece 18.

Figure 4:
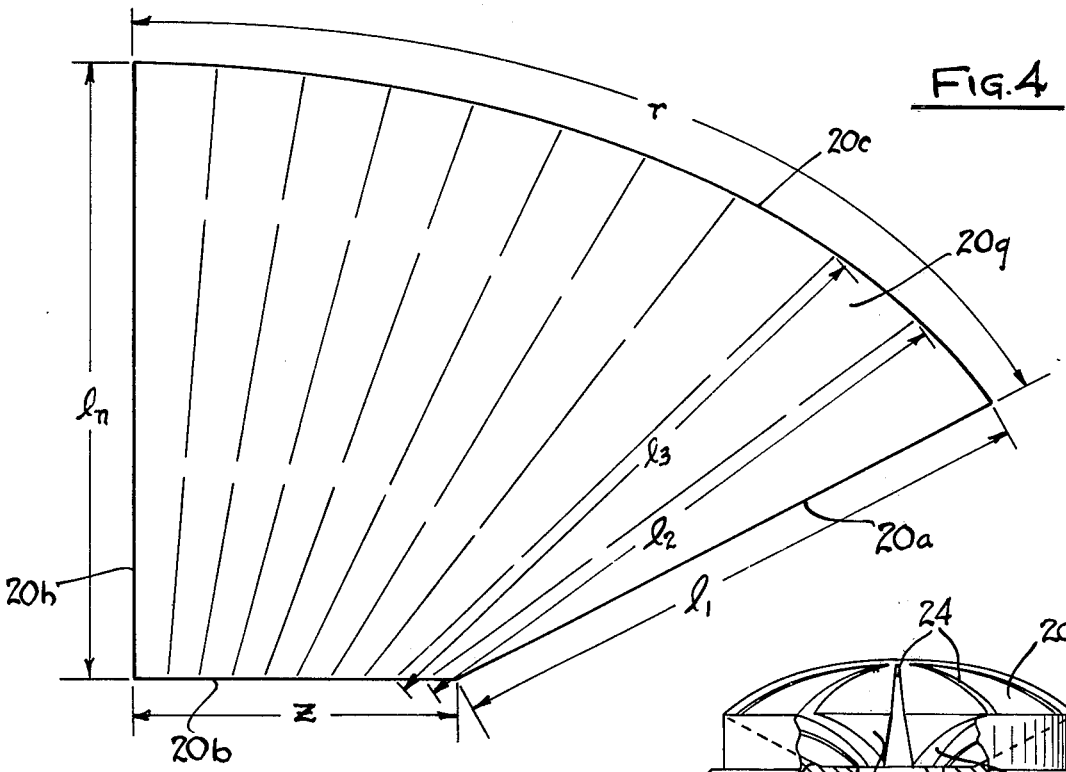

Referring now to FIGS. 4, 7A and 7B, the exponential curvature of the side surfaces 20*g* of the channels is such that the straight line distances $\mathbf{1}_1$–$\mathbf{1}_n$ between corresponding points on curved surface 20*c* and straight edge 20*b* are all equal, i.e., if we divide surface 20*c* and edge 20*b* into the same number of equal parts, then, if line $\mathbf{1}_n$ is made equal to line $\mathbf{1}_1$, the lengths of the lines, $\mathbf{1}_2$, $\mathbf{1}_3$ . . . , $\mathbf{1}_{n-1}$ forming the edges of each of these parts will all be substantially equal to each other. This is illustrated in FIG. 4 where, as can clearly be seen by further reference to FIG. 6, "*r*" is the length of the arc between the outer and inner top edge of each of plug sections 20*e* and "*z*" is the length of the edge portions of each of these sections. The straight lines "$\mathbf{1}_1$-$\mathbf{1}_n$" join together corresponding equispaced points along "*r*" and "*z*". The curvature of surface 20*g* is made such that lines $\mathbf{1}_1$-$\mathbf{1}_n$ are all equal to each other. As already noted, the curvature of surface 20*c* is made to match that of the speaker diaphragm, while edge 20*b* is made planar to match the throat of the horn. Flat surface 20*a* of the plug fits tightly against surface 18*a* of pole piece 18, so that the sound energy is closely directed through channels 24 to the throat of the horn, there being no superfluous air spaces between adjacent channels.

In the preferred embodiment, a prime number of channels is provided, in the illustrative embodiment this number being 11. This minimizes the development of harmonic signals on the diaphragm with its resultant distortion.

Referring now to FIG. 5, certain dimensional relationships for optimum design of the plug are schematically illustrated. The dimension "$\mathbf{1}_d$" shown in FIG. 5 is the distance between the center of each of plug segments 20*e* and the center of each adjacent channel 24, as measured at the outer periphery of each such segment. The dimension "$\mathbf{1}_d$" is preferably made as small as feasible and should in any event be less than a quarter-wave length at the highest frequency of interest. This is because the quarter-wave resonance provided by the dimension "$\mathbf{1}_d$" in effect operates as a turning stub which attenuates soundwaves at and near this resonant frequency.

Referring now to FIG. 8, a modified embodiment of the invention is illustrated. This embodiment is the same as the previous embodiment except for the inclusion of an aperture 35 which is formed in the center portion 20*f* of the plug. The use of this aperture tends to prevent the formation of resonant acoustic paths and thus tends to improve the operation of the plug at the higher frequencies. The use of such an aperture is particularly helpful with larger sized phasing plugs.

While the invention has been described and illustrated in detail, it is to be clearly understood that this is intended by way of illustration and example only and is not to be taken by way of limitation, the spirit and scope of the invention being limited only by terms of the following claims.

I claim:

1. An acoustical transformer for coupling sound from a dome shaped speaker diaphragm to the planar throat of a horn comprising a member having a dome shaped surface having a curvature corresponding to that of said diaphragm, a surface opposite said dome shaped surface having a truncated conical shape, a central plug portion, a plurality of radial slots formed in said member, said slots being spaced from each other around said member and extending through said member between the opposite surfaces thereof, running from said plug radially outwardly to the outer edges of said member, sections of said member being formed between said slots, the opposite wall surfaces of adjacent member sections having an essentially exponential curvature, said slots forming essentially exponentially tapered sound channels, the sound entry end of said channels being along said dome shaped surface, the sound exit end of said channels being along the truncated end of said opposite surface, said truncated end being planar, the distances between corresponding points along the wall surfaces at the entry ends and the exit ends of said channels being substantially equal, whereby sound waves generated by said diaphragm having a spherical wave front and entering the channels at the entry end thereof are transformed to waves having a planar wave front at the exit end thereof for coupling to the throat of said horn.

2. The acoustical transformer of claim 1 wherein said central plug portion has a truncated conical shape tapering inwardly between the dome shaped surface and the truncated end of said conical surface.

3. The acoustical transformer of claim 1 wherein the ends of the channel walls along the truncated end of said opposite surface have sharp edges.

4. The acoustical transformer of claim 1 wherein the plug portion has an aperture formed therethrough extending between said opposite surfaces.

5. The acoustical transformer of claim 1 wherein the distance between the centers of said sections at the outermost periphery thereof and the centers of said channels is less than a quarter-wavelength at the maximum frequency of the sound waves to be transformed.

6. The acoustical transformer of claim 1 wherein the number of said channels is a prime number.

7. In a horn type loudspeaker, a dome shaped speaker diaphragm, a horn having a planar throat, a cylindrical member having an aperture formed through its center and having a conically dished portion surrounding said aperture, and an acoustical transformer for coupling the sound output of said diaphragm to the throat of the horn, said transformer comprising a member having a dome shaped surface with a curvature corresponding to that of said diaphragm and positioned directly opposite the diaphragm, a truncated conical surface opposite said dome shaped surface, the truncated end of said truncated conical surface being planar and positioned directly opposite the horn throat and in a plane parallel to that of the throat, the sides of said conical surface fitting snugly in the conically dished portion of the cylindrical member, a central plug portion extending between said opposite surfaces, a plurality of radial slots formed around said member and extending therethrough between the opposite surfaces thereof, said slots running from said plug portion radially outwardly to the outer edges of said member, sections of said member being formed between said slots, the opposing wall surfaces of adjacent sections forming said slots being essentially quadric said slots forming essentially exponential sound channels running between said diaphragm and said horn throat, the distances between corresponding points along each of said wall surfaces at the diaphram ends and the horn throat ends of said channels being substantially equal, whereby the spherical wavefronts of waves generated by said diaphragm are transformed by the transformer to planar wavefronts for coupling to the horn throat.

8. The combination of claim 7 wherein said cylindrical member comprises a pole piece.

9. The combination of claim 7 wherein the ends of the channel walls along the truncated end of said truncated conical surfaces have sharp edges.

10. The combination of claim 7 wherein the plug portion has a truncated conical shape tapering inwardly from the dome shaped surface to the truncated portion of said truncated conical surface.

11. The combination of claim 7 wherein the number of said channels is a prime number.

12. The combination of claim 7 wherein said plug portion has an aperture extending therethrough extending between said opposite surfaces.

* * * * *